US007054583B2

(12) United States Patent
Hirobe

(10) Patent No.: US 7,054,583 B2
(45) Date of Patent: May 30, 2006

(54) DEVELOPING DEVICE INCLUDING TWO DEVELOPER CARRYING MEMBERS

(75) Inventor: Fumitake Hirobe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 10/675,988

(22) Filed: Oct. 2, 2003

(65) Prior Publication Data

US 2004/0076451 A1 Apr. 22, 2004

(30) Foreign Application Priority Data

Oct. 7, 2002 (JP) ..... 2002-293917

(51) Int. Cl.
*G03G 15/09* (2006.01)

(52) U.S. Cl. ..... 399/269; 399/276; 399/277

(58) Field of Classification Search ..... 399/267, 399/269, 274, 276, 277
See application file for complete search history.

(56) References Cited

U.S. PATENT DOCUMENTS 5,930,569 A * 7/1999 Roof et al. ..... 399/269
6,459,862 B1 10/2002 Sakemi et al. ..... 399/55

* cited by examiner

*Primary Examiner*—William J. Royer
(74) *Attorney, Agent, or Firm*—Fitzpatrick, Cella, Harper & Scinto

(57) ABSTRACT

A developing device having a first developing sleeve for supplying developing agent to the first developing area A, and a second developing sleeve for supplying developing agent, handed from the first developing sleeve, to a second developing area B, the surfaces of the first developing sleeve and the second developing sleeve are subjected to roughening such that the average inter-peak distances thereof differ between the first developing sleeve and the second developing sleeve. This prevents fusion of toner due to toner particles becoming embedded in recesses of course formations on the surface of the developing sleeves, resulting in extensive usage periods yielding high image quality.

13 Claims, 5 Drawing Sheets

DEVELOPING DEVICE INCLUDING TWO DEVELOPER CARRYING MEMBERS

BACKGROUND OF THE INVENTION

1. Field of the Invention

The present invention relates to a developing device for developing electrostatic images formed on an image carrying member by electrophotography or electrostatic recording methods, particularly used in photocopiers, printers, facsimile apparatuses, and so forth.

2. Description of the Related Art

Image formation apparatuses such as photocopiers and the like which use electrophotography cause a developing agent to adhere to an electrostatic image formed on an image carrying member such as photosensitive drum or the like. As for the developing agent, there are magnetic single-component developing agents, non-magnetic single-component developing agents, and two-component developing agents which have non-magnetic toner and a magnetic carrier. The different types of developing agents are used as appropriate.

FIG. 1 illustrates an example of a conventional developing device 1 suitable for adaptation according to the present invention using a two-component developing agent having non-magnetic toner and a magnetic carrier.

The developing device 1 shown in FIG. 1 has a developing container 2, and disposed inside the developing container 2 are two transporting screws 5 and 6 for stirring and transporting the developing agent, and two developing sleeves 8 and 9 disposed one upon the other, for developing an electrostatic latent image formed on an image carrying member 10.

In further detail, the developing device 1 has first and second developing sleeves 8 and 9 serving as developing agent carrying members disposed one upon another at an opening of the developing container 2 facing the photosensitive drum 10 serving as the image carrying member. A developing chamber 3 and a stirring chamber 4 separated by a partitioning wall 7 are formed at the far side from the opening of the developing container 2, with the developing chamber 3 formed above the stirring chamber 4. The first and second transporting screws 5 and 6 serving as the developing agent stirring and transporting means are disposed within the developing chamber 3 and stirring chamber 4, respectively.

The developing agent transported from the stirring chamber 4 to the developing chamber 3 is scooped up by the developing sleeve 8 by means of an N1 pole provided within a magnetic roller 8a which is magnetic field generating means provided in a non-rotating manner within the developing sleeve 8, and the rotation of the developing sleeve 8 bring the developing agent to a first developing area A where a developing magnetic pole S2 is situated, where the developing sleeve 8 and the photosensitive drum 10 face one another. Along the way, the layer of developing agent is subjected to restriction of thickness thereof by means of a developing agent restricting blade 11 which is a developing agent restricting member and a magnetic pole S1 facing the developing agent restricting blade 11 and acting in cooperation therewith. This forms a thin layer of developing agent, whereby the electrostatic latent image is developed at the first developing area A from the magnetic pole N3 situated downstream of the first developing area A in the direction of rotation of the developing sleeve 8 (first developing step).

Subsequently, the developing agent is handled to a magnetic pole S3 of a magnetic roller 9*a* which is magnetic field generating means provided in a non-rotating manner within the developing sleeve 9, and reaches a second developing area B where the developing sleeve 9 and the photosensitive drum 10 face one another (second developing step). The developing agent remaining at the second developing area B without being developed is transported into the developing container 2, and is recovered in the stirring chamber 4 at the lower portion of the developing container 2.

The characteristics of the above-described vertical-stirring twin-sleeve developing device 1 include the advantages in that:

(1) The size of the developing device 1 can be reduced due to the two transporting screws 5 and 6 being vertically disposed; and (2) The number of times that developing can be performed is increased as compared with single-sleeve arrangements due to the developing sleeves 8 and 9 being provided, whereby developing efficiency increases, edge enhancement can be reduced, and further, the rotations of the developing sleeves 8 and 9 can be reduced.

Now, the materials and configurations of the above-described developing sleeves 8 and 9 are selected as appropriate depending on the type of developing agent to be used. For example, in the event of using a two-component developing agent, a developing sleeve having magnetic field generating means such as a magnet or the like within is used, and primarily non-magnetic metals such as stainless steel or aluminum have conventionally been used as the material of the developing sleeve.

With a developing device 1 such as described above, the surface of the developing sleeve is subjected to surface-roughening processing, which improves the transporting capabilities of the sleeves transporting the two-component developing agent made up of toner and carrier to the developing areas, and also enables uniform coating of the developing agent on the developing sleeve.

Methods that have been proposed and implemented for roughening the surface of developing sleeves include sanding with sandpaper, beads blasting using spherical particles, sand blasting using indeterminate-form particles, combinations of the above methods, chemical etching using chemical processes, and so forth. However, conventional sleeves have had the following problems.

After developing sleeves of which the surface has been roughened by the above methods have been used for extended periods, a problem develops in that the toner or components in the toner tend to catch on and adhere to the coarse formations formed on the roughened surface. The toner adhering to the "valley" portions eventually fuse due to friction heat and the like, and consequently, the developing sleeve is stained. Further, in the event of using a two-component developing agent containing a carrier, the toner particles or particles of components in the toner tend to be pressed into the valley portions, and particularly the narrow valley portions of the coarse formations formed on the roughened surface, due to being pressed by the carriers, where they become embedded. The embedded toner particles eventually fuse due to extended use, and the sleeve surface tends to become stained by toner.

Further, the demand for increased image quality and increased speed, and demand for reduced electrical power consumption, in accordance with the increased demand for color photocopiers and the like, has led to smaller particles and lower softening points for the toner, so the tendency for the toner or toner components to fuse to the coarse formations formed on the roughened surface and lead to staining is becoming even stronger.

Once toner fuses to the surface of the developing sleeves, first, the image density begins to deteriorate since the amount of developing agent transported to the developing areas decreases. Also, a developing bias with DC voltage and/or AC voltage superimposed has been conventionally applied to the developing sleeves at the time of developing, in order to carryout suitable developing, but toner fused to the surface of the developing sleeve creates a high-resistance layer of the fused substance on the surface of the developing sleeve, and accordingly, a desired electrical field may not be formed at the developing area between the developing sleeve and the image carrying member at the time of developing. Consequently, sufficient developing effects of the developing bias cannot be obtained, leading to substandard images such as images with inferior image density or white spots.

Actual experimentation has shown this to be true. An experiment performed with a developing sleeve having staining comparable to that of a developing sleeve used for 10,000 copies yielded image density 0.2 lower than that of an unstained developing sleeve, and also yielded substandard images such as images with white spots.

Carrying this experiment out further with a twin-sleeve developing device showed that there was difference in the level of staining between the first developing sleeve 8 and the second developing sleeve 9.

The sleeve staining was measured by measuring the reflection of light off of developing sleeves before and after usage, using a reflective densitometer, with the optical density difference ΔD taken as the staining density. As a result, the staining level of the first developing sleeve 8 was 0.30, while the staining level of the second developing sleeve 9 was 0.15, showing that the staining of the first developing sleeve 8 was more severe.

Studying the reason for this in detail showed that a major factor in the staining level of the first developing sleeve 8 was the fact that the first developing sleeve 8 faces the developing agent restricting blade 11. This staining can be thought to be due to fusion of the toner owing to being pressed by the developing agent restricting blade 11.

Also, with the twin-sleeve developing method, the potential difference between electrostatic latent images is small in the first developing step with the first developing sleeve 8, and the final image quality is determined in the second developing step with the second developing sleeve 9, and so it has been found that developing capabilities depend on the developing efficiency of the first developing sleeve 8, and micro-level dot reproducibility, white spots, lop-sided distribution and like edge enhancement and the like, and other such macro-level image quality, strongly depends on the state of the magnetic brush of the second developing sleeve 9.

Accordingly, with the twin-sleeve developing method, it is important to prevent deterioration of developing due to staining of the first developing sleeve 8 as much as possible, and to prevent deterioration of the formation of the magnetic brush and transportation at the second developing sleeve 9.

SUMMARY OF THE INVENTION

It is an object of the present invention to provide a developing device capable of preventing both staining due to fusing of toner to the developer carrying member, and deterioration in image quality.

According to a first aspect of the present invention, a developing device for developing an electrostatic image formed on an image carrying member comprises: a developing container for containing a developer including toner and carrier; a first developer carrying member for carrying the developer within the developing container and supplying the developer to the electrostatic image formed on the image carrying member; a restricting member for restricting thickness of the developer carried on the first developer carrying member; and a second developer carrying member for carrying the developer received from the first developer carrying member and supplying the developer to the electrostatic image formed on the image carrying member, wherein an average inter-peak distance on the surface of the first developer carrying member is greater than an average inter-peak distance on the surface of the second developer carrying member. This enables fusion of toner on the first developer carrying member due to the restricting member to be prevented, while maintaining the developer transporting capabilities of the second developer carrying member, so high-quality images can be obtained over extensive usage periods.

According to a second aspect of the present invention, a developing device for developing an electrostatic image formed on an image carrying member, comprises: a developing container for containing a developer including toner and carrier; a first developer carrying member for carrying the developer within the developing container and supplying the developer to the electrostatic image formed on the image carrying member; a restricting member for restricting thickness of the developer carried on the first developer carrying member; and a second developer carrying member for carrying developer received from the first developer carrying member and supplying the developer to the electrostatic image formed on the image carrying member; wherein the expression $$(Rz1/Sm1)<(Rz2/Sm2)$$

is satisfied; wherein Sm1 represents an average inter-peak distance on the surface of the first developer carrying member, Sm2 represents an average inter-peak distance on the surface of the second developer carrying member, Rz1 represents a ten-point average roughness of the first developer carrying member, and Rz1 represents a ten-point average roughness of the second developer carrying member.

Further objects, features and advantages of the present invention will become apparent from the following description of the preferred embodiments with reference to the attached drawings.

DESCRIPTION OF THE PREFERRED EMBODIMENTS

The following is a more detailed description of a developing device and image formation apparatus according to the present invention, with reference to the drawings.

First Embodiment

Figure 5:
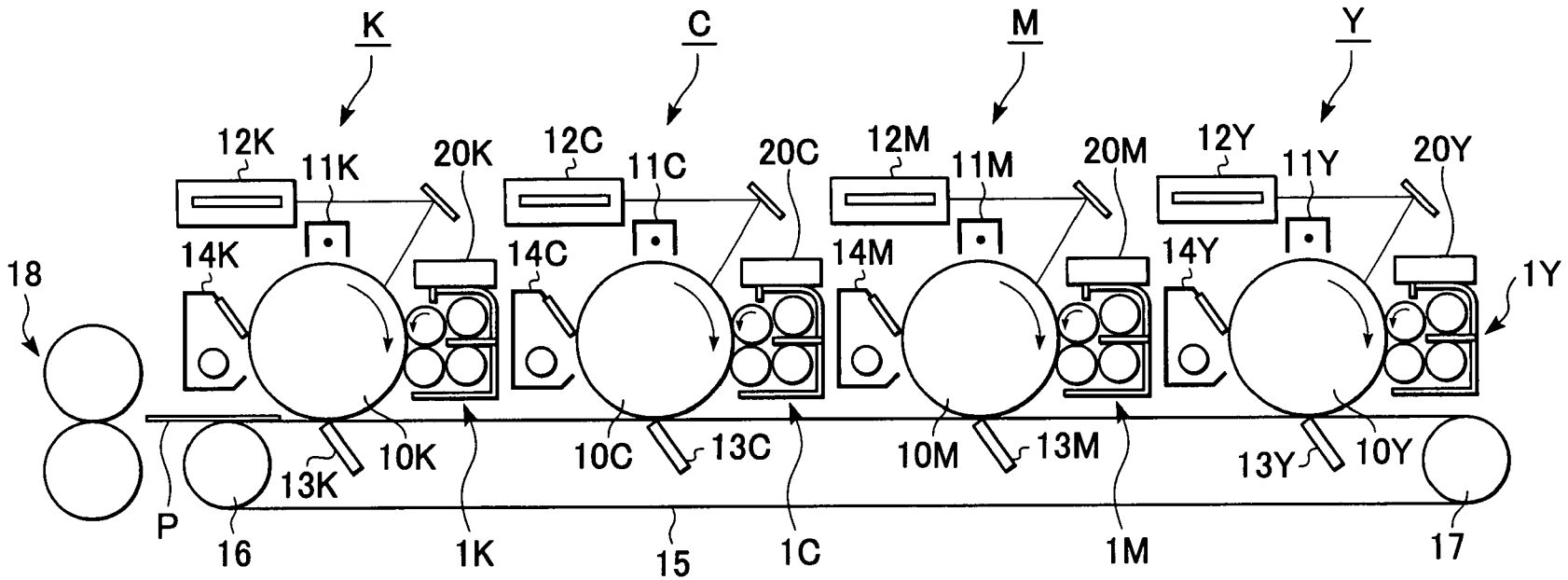
FIG. 5 is a schematic configuration diagram of an image formation apparatus using the developing device according to an embodiment of the present invention.

FIG. 5 illustrates an embodiment of an image formation apparatus to which the developing device according to the present invention can be suitably applied. The image formation apparatus according to the present embodiment is a tandem-type full-color image formation apparatus wherein image formation stations are serially arrayed, but the image formation apparatus according to the present invention is not restricted to this arrangement.

In the embodiment, the full-color image formation apparatus has the four image formation stations of Y, M, C, and K. The stations Y, M, C, and K are each of the same configuration, and form yellow (Y), magenta (M), cyan (C), and black (K) images in the full-color images.

The stations Y, M, C, and K have drum-shaped electrophotography photosensitive members serving as image carrying members, i.e., photosensitive drums 10 (10Y, 10M, 10C, and 10K). Disposed around the photosensitive drums 10 (10Y, 10M, 10C, and 10K) are primary chargers 11 (11Y, 11M, 11C, and 11K), laser exposing optical systems 12 (12Y, 12M, 12C, and 12K), developing devices 1 (1Y, 1M, 1C, and 1K), transfer devices 13 (13Y, 13M, 13C, and 13K), and cleaning devices 14 (14Y, 14M, 14C, and 14K). A recording medium transporting belt 15 for transporting a recording medium P is stretched between rollers 16 and 17, below the photosensitive drums 10 (10Y, 10M, 10C, and 10K).

In the following description, in the event that reference is made to the developing device 1, for example, it should be understood that this refers in common to the developing device 1Y, developing device 1M, developing device 1C, and developing device 1K, of the stations Y, M, C, and K.

First, the operations of the overall image formation apparatus will be described with reference to FIG. 5. The photosensitive drum 10 which is an image carrying member is rotatably provided, and the primary charger 11 uniformly charges the photosensitive drum 10. Next, the photosensitive drum 10 is exposed with a beam modulated according to information signals by the laser exposing optical system 12 having light-emitting elements such as for laser beams, whereby an electrostatic latent image is formed.

The electrostatic latent image is visualized as a developed image (toner image) due to later-described developing actions of the developing device 1.

The toner image is transferred by the transfer device 13 onto a recording medium P which is transported by the recording medium transporting belt 15, for each of the stations Y, M, C, and K, and further fixed by a fixer 18, so as to obtain a permanent image. Any toner remaining on the photosensitive drum 10 following transfer is removed by the cleaning device 14.

The toner from the developing agent (developer) made up of magnetic carrier and non-magnetic toner (hereafter referred to simply as "toner") consumed in the image formation is constantly replenished from a toner replenishing vat 20(20Y, 20M, 20C, and 20K).

With the present embodiment, a method is used wherein the toner image is directly transferred from the photosensitive drums 10 (10Y, 10M, 10C, and 10K) onto the recording member P transported by the recording medium transporting belt 15, but an arrangement may be made to which the present invention can be suitably applied wherein an intermediate transfer medium is provided instead of the recording medium transporting belt 15, and following transfer of the toner images of each color from the photosensitive drums 10M, 10C, 10Y, and 10K, onto the intermediate transfer medium, the combined toner image is subjected to secondary transfer to the recording medium P all at once.

Figure 1:
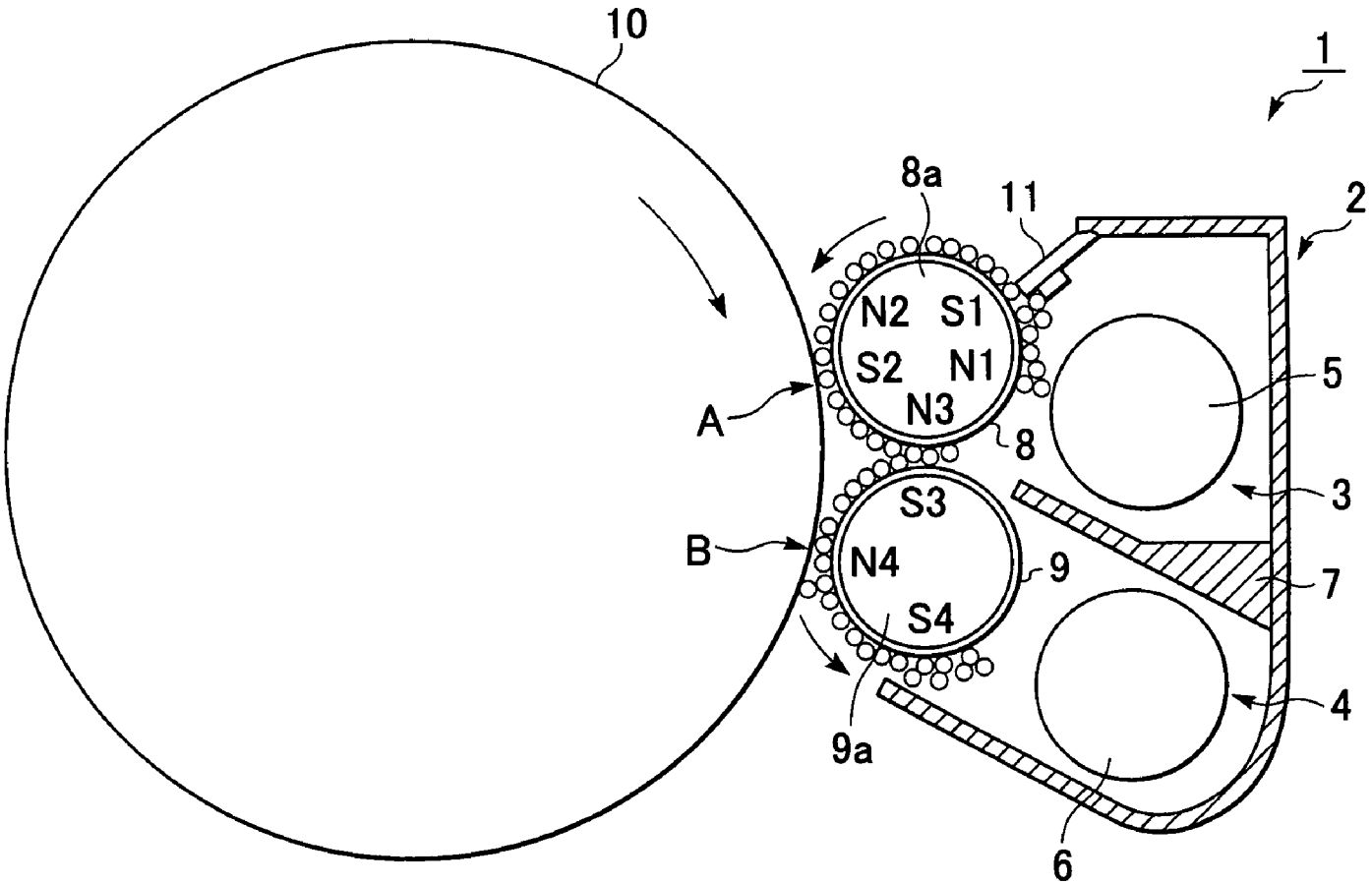
FIG. 1 is a schematic cross-sectional configuration diagram of a conventional developing device suitable for use with an embodiment of the developing device according to the present invention.

Next, the developing device 1 adapted according to the present invention will be described. It should be noted that the developing device 1 according to the present invention is not restricted to that described below, but can be suitably carried out in the developing device 1 described with reference to FIG. 1. The configuration and actions of the developing device 1 will be described in further detail.

The developing device 1 suitable for adaptation according to the present embodiment of the invention has a developing container 2 storing a two-component developing agent including non-magnetic toner and magnetic carrier, and disposed inside the developing container 2 are two transporting screws 5 and 6 for stirring and transporting the developing agent, and first and second developing sleeves 8 and 9 serving as first and second developer carrying members. Also, a restricting blade 11 serving as a restricting member for restricting the thickness of the developing agent carried on the surface of the first developing sleeve 8, is positioned so to face the first developing sleeve 8.

In further detail, the developing device 1 has the first developing sleeve 8 and the second developing sleeve 9 serving as developing agent carrying members disposed one upon another at an opening of the developing container 2 facing the photosensitive drum 10. A developing chamber 3 and a stirring chamber 4 separated by a partitioning wall 7 are formed at the far side from the opening of the developing container 2, with the developing chamber 3 formed above the stirring chamber 4, with the first and second transporting screws 5 and 6 serving as the developing agent stirring and transporting means disposed within the developing chamber 3 and stirring chamber 4, respectively. The first transporting screw 5 transports developing agent within the developing chamber 3, and the second transporting screw 6 transports the toner supplied from above the second transporting screw 6 from the toner replenishing vat 20 to the stirring chamber 4, and the developing agent already within the stirring chamber 4, while stirring.

The developing agent transported from the developing chamber 3 to the first developing sleeve 8 is scooped up by the developing sleeve 8 by means of an N1 pole provided within a magnetic roller 8a which is magnetic field generating means provided in a non-rotating manner within the first developing sleeve 8, and the rotations of the first developing sleeve 8 transport the developing agent on the first developing sleeve 8 from a magnetic pole S1 to N2, and bring the developing agent to a first developing area A where a developing magnetic pole S2 is situated, where the developing sleeve 8 and the photosensitive drum 10 face one another. At this time, the developing agent is magnetically formed into a magnetic brush by the magnetic roller 8a, and the magnetic brush formed of the developing agent comes into contact with the surface of the photosensitive drum 10. Along the way, the layer of developing agent is subjected to restriction of thickness thereof by means of the developing agent restricting blade 11 which is a developing agent restricting member and a magnetic pole S1 facing the developing agent restricting blade 11 and acting in cooperation therewith. This forms a thin layer of developing agent, so as to perform the first developing step at the first developing area A.

Subsequently, the developing agent is handed to a magnetic pole S3 of a magnetic roller 9*a* which is magnetic field generating means provided in a non-rotating manner within the second developing sleeve 9, from a magnetic pole N3 downstream in the direction of rotation of the first developing sleeve 8 from the first developing area A. Next, the developing agent is carried and transported by the second developing sleeve 9 and reaches a second developing area B where the second developing sleeve 9 and the photosensitive drum 10 face one another, to be supplied to the second developing step. The magnetic brush on the second developing sleeve 9 is formed at the second developing area B, and comes into contact with the surface of the photosensitive drum 10.

The developing agent remaining at the second developing area B without being developed is transported into the developing container 2 by a magnetic pole S4 downstream in the direction of rotation of the second developing sleeve 9 from the second developing area B, is removed from the developing sleeve 9 by the repelling magnetic field of magnetic poles S3 and S4, and is recovered into the stirring chamber 4 at the lower portion of the developing container 2. Subsequently, the recovered developing agent is transported to the developing chamber again, while being stirred with the replenished toner. This completes the cycle of developing agent with the developing device 1 according to the present embodiment.

Now, a vibrating bias voltage wherein a DC voltage has been superimposed on an AC voltage is applied to the first and second developing sleeves 8 and 9, in order to increase the developing efficiency.

Also, the first and second developing sleeves 8 and 9 have same-pole portions (N1–N3 poles and S3–S4 poles) therein, and areas wherein the magnetic force is approximately 0 mT (repelling poles) are provided between these magnets. This prevents developing agent from being dragged around the face of the developing sleeve, so the toner does not adhere and collect on the face of the sleeve as readily, therefore serving to reduce fusing of toner onto the sleeves. Also, poles which are inverse to each other, i.e., which attract each other, are preferably positioned facing one another at the position where the distance between the two sleeves is the nearest as with the present embodiment (the N3 pole and S3 pole with the present embodiment), in order to hand the developing agent from the first developing sleeve 8 to the second developing sleeve 9 more optimally.

However, from the perspective of sleeve staining, with an arrangement wherein there are magnets with opposite polarity at the nearest portion, the magnetic brushes are caused therebetween which leads to worse staining of the sleeves, so the magnetic field should not be very strong at the nearest portion. Specifically, setting the intensity of the magnetic fields of each of the N3 and S3 poles to between 45 mT to 60 mT enables the staining level on the developing sleeve 9 to be reduced to 0.10.

Also, a magnetic field for handling the developing agent from the first developing sleeve 8 to the second developing sleeve 9 may be formed with the developing magnet within the first developing sleeve 8 (opposite polarity to the magnetic around the nearest portion) and the developing magnet within the second developing sleeve 9 (opposite polarity to the magnet around the nearest portion), with same poles facing one another around the nearest portion. With this configuration, there is almost no formation of the magnetic burst between the developing sleeves, so sleeve staining at the portion for handing over the developing agent can be completely prevented.

Next, the surface configuration of the first and second developing sleeves 8 and 9, which characterize the developing device 1 according to the present invention, will be described in detail.

As described above, the developing device 1 according to the present invention uses SUS or aluminum as the material for the developing sleeves. Description will be made with reference to an example wherein indefinite-form alumina particles (ARD) or spherical glass bead particles (FGB) are used as the polishing grains to subject the surface of the developing sleeves to roughening processing which forms roughness of the surfaces thereof to realize transportation of the developing agent. The indeterminate-form alundum particles used had the granularity stipulated by JIS R6001. Also, the spherical glass bead particles used had the granularity No. stipulated by JIS R3801.

Further, measurement of the surface roughness was carried out using a contact surface roughness measuring instrument ("Surfcorder SE-3300" manufactured by Kosaka Laboratory Ltd.) This measuring instrument is capable of measuring the ten-point average roughness Rz (JIS B0601) and the inter-peak distance Sm (JIS B0601) of the developing sleeve surface with a single measurement. The measurement conditions were: cut-off value of 0.8 mm, measurement length of 2.5 mm, feed speed of 0.1 mm/sec, and magnification of 5000×. Here, definitively, the roughness Rz represents the difference in height between the peaks and troughs of the rough formations on the surface of the developing sleeves.

Figure 2:
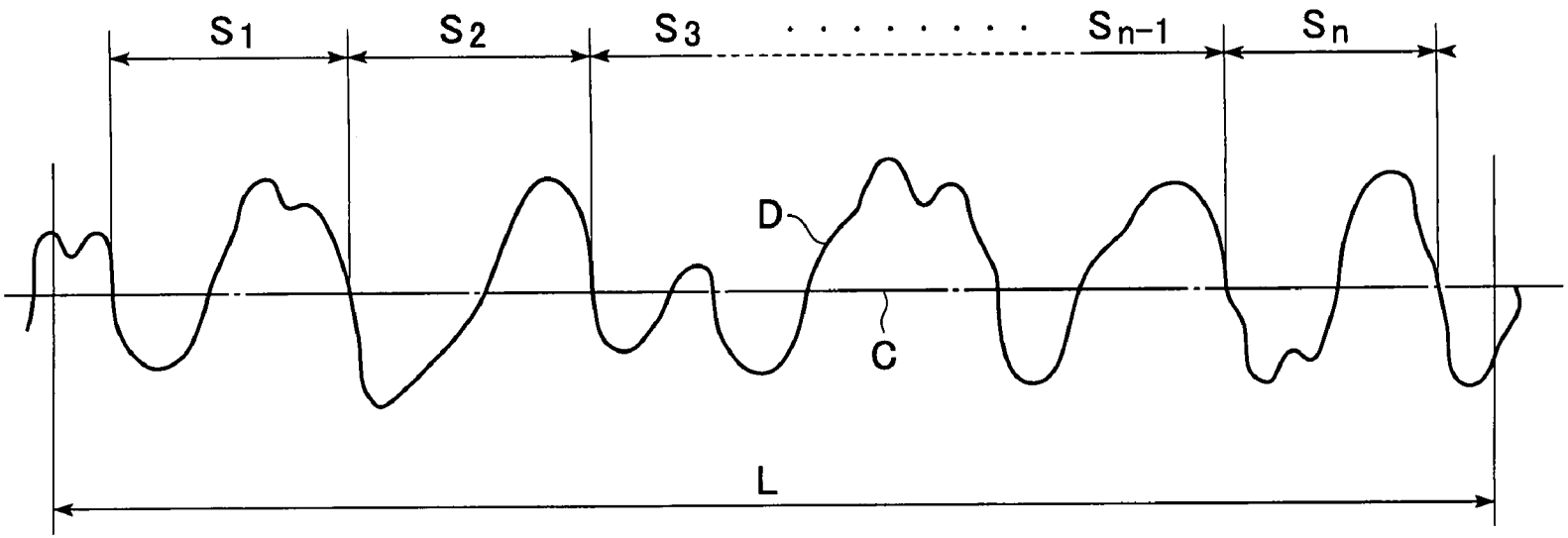
FIG. 2 is a diagram wherein the surface of the developing sleeve shown in FIG. 1 has been enlarged, to describe the average inter-peak distance Sm of the developing sleeve.

Also, the inter-peak distances Sm should be understood as follows. As shown in FIG. 2, a portion of a reference length (measurement length) L is cut out from the cross-sectional curve D of the surface that has been subjected to roughening processing. In this cross-sectional curve D, the distance from the first point intersecting a center line C following a peak and leading to a trough to the next point intersecting the center line following a peak and leading to a trough is S1, and the subsequent distances between like intersection points are S2, S3, and so on through Sn (wherein n is the total number of such intersection points within the reference length). The average inter-peak distance is obtained by adding these distances S1 through Sn and dividing by n, and is expressed by Sn in the following expression:

$$Sm=(S1+S2+\ldots Sn)/n$$

Thus, the distance Sm represents the average distance between adjacent peaks on the surface of the developing sleeve.

The surface roughness information of the developing sleeve obtained in this way, and the degree of staining of the first and second developing sleeves 8 and 9 with toner following extended use of 10,000 copies, were compared. A two-component developing agent having a magnetic carrier with a grain diameter average by weight of 40 μm and a non-magnetic toner with a grain diameter average by volume of 7 μm was used for the consideration here. Also, evaluation of the stain density was performed by measuring the reflected light off of the surface of the developing sleeve before and following the aforementioned use, and evaluating the optical density difference ΔD.

With a First Experiment Example (First Comparative Example), first and second developing sleeves 8 and 9 formed of SUS were blasted using indeterminate-form alumina particles (ARD #400) under the same conditions, to roughen the surfaces thereof.

With these developing sleeves, Rz=4 μm and Sm=13 μm, and following extended use of 10,000 copies, it was found that toner fused to the surface of both the first and second developing sleeves 8 and 9, although there is some difference in the degree of staining thereof, as shown in Table 1 later.

However, due to the high friction factor from the blasting processing using the indeterminate-form particles, there was no trouble in transportation of the developing agent. This phenomenon is then thought to be due to the following.

That is to say, with the two-component developing method, a developing sleeve magnetically holds the magnetic carrier (i.e., the magnetic brush) with toner adhered thereto, and thus transports to the developing area. In this process, even in the event that there is toner which has come into direct contact with the surface of the developing sleeve, this toner comes in contact with the carrier and thus is carried by the carrier in the carrier cycle, so consequently, there is no collecting of toner on the developing sleeve, and accordingly staining does not readily occur.

However, in the event that the inter-peak distance Sm of the surface of the developing sleeve is far smaller than the average granularity by weight of the magnetic carrier as with the first experiment example (first comparative example), the toner particles can be forced into the troughs on the surface of the developing sleeve by the pressure of the carrier and so forth, but the carrier particles cannot be pressed into these troughs. Consequently, the toner in the troughs has no opportunity to come into contact with carrier particles in the carrier cycle and accordingly remains attached to the trough, and it is thought that these toner particles become fused to the surface of the developing sleeve. We subsequently deduced that the arrangement wherein the average inter-peak distance Sm of the developing sleeve surface is far smaller than the average granularity by weight of the magnetic toner is the cause of fusion of toner to the surface of the developing sleeve.

To examine this point, with a Second Experiment Example (Second Comparative Example), blasting was performed to roughen the surface using indeterminate-form alumina particles with a coarser grain (ARD #150), greater than that used with the first experiment example (first comparative example). With these developing sleeves, Rz=10 μm, and Sm=40 μm which is approximately the same as the grain diameter average by weight of 40 μm of the magnetic carrier. Endurance testing using this developing sleeve showed reduced staining levels are compared with the first experiment example (see Table 1).

The improvement of the sleeve staining level in the second experiment example can be considered to be as follows. Considering the cause of sleeve staining to be fusion of toner catching on the surface of the sleeve for long periods of time, increased number of times of contact between the carrier and toner can be thought to be effective in preventing staining. That is to say, generally increasing the average inter-peak distance Sm improves the number of times of contact between the carrier and toner, so increasing the average inter-peak distance Sm from 13 μm to 40 μm is what caused the improvement.

Also, studying the relation between the sleeve staining and transportation of the developing agent with regard to the average granularity by weight D of the carrier and the average inter-peak distance Sm, it was found that fusing of toner can be effectively suppressed within the range of $$D/3 \leqq Sm\ 3\times D$$

and more particularly $$D/2 \leqq Sm\ 2\times D.$$

That is, in the event that the value of the average inter-peak distance Sm is D/3 or greater, even in the event that toner enters into the troughs in the surface of the developing sleeve, the toner particles come into contact with carrier particles in the process of the carrier cycling and are carried away, so consequently, there is no collecting of toner on the surface of the sleeve, and the staining level can be effectively reduced. However, in the event that the average inter-peak distance Sm exceeds 3×D, the capabilities of the developing sleeve to transport the developing agent are insufficient, leading to problems in practical use.

As described above, suitably adjusting the average inter-peak distance Sm according to the average granularity by weight of the carrier to be used enables the level of staining to be reduced.

Next, a Third Experiment Example (Embodiment A) was studied using determinate-form spherical particles instead of the indeterminant-form particles for the blasting particles.

Specifically, the surface of an aluminum developing sleeve was subjected to roughening processing using spherical glass beads. The blasting processing was performed so as to yield different Sm values for the first and second sleeves, taking note of the fact that the levels of staining of the first developing sleeve and the second developing sleeve were not the same in the earlier experiment. Specifically, the first developing sleeve was blasted using FGB #300 particles and the second developing sleeve was blasted using FGB #100 particles, so that the Sm value of the second developing sleeve would be smaller than the Sm value of the first developing sleeve. The surface conditions of the developing sleeves thus obtained under the above conditions were Rz=5 μm and Sm=40 μm for the first developing sleeve, but Rz=5 μm and Sm=30 μm for the second developing sleeve.

Further study using these developing sleeves showed that even though the surface state of the sleeves (average inter-peak distance and ten-point average roughness) was the same as that of the above-described second experiment example (second comparative example), the staining of the first developing sleeve following extensive use of 10,000 copies could be reduced even further than with the second experiment example (second comparative example). It was also found that reducing the average inter-peak distance on the second developing sleeve does not worsen the staining level. On the other hand, dot reproducibility was improved with regard to the image quality.

TABLE 1

| | First Experiment Example First developing sleeve Second developing sleeve | Second Experiment Example First developing sleeve Second developing sleeve | Third Experiment Example First developing sleeve Second developing sleeve | |
|---|---|---|---|---|
| Developing sleeve material | SUS | SUS | Aluminum | Aluminum |
| Blasting for developing sleeve | ARD #400 | ARD #150 | FGB #300 | FGB #100 |
| Average inter-peak distance Sm | 13 μm | 40 μm | 40 μm | 30 μm |
| Ten-point average roughness Rz | 4 μm | 10 μm | 10 μm | 10 μm |
| Staining density (ΔD) | 0.30/0.10 (First developing sleeve/ Second developing sleeve) | 0.20/0.07 (First developing sleeve/ Second developing sleeve) | 0.05 μm | 0.05 μm |

Figure 3A:
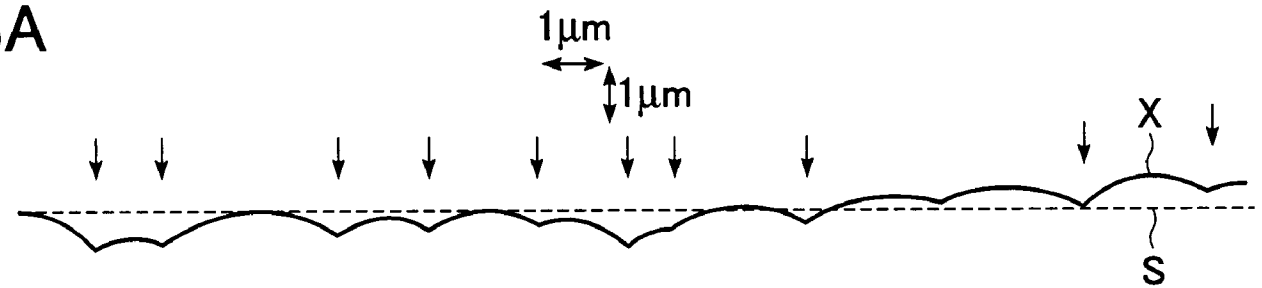
FIGS. 3A and 3B are diagrams wherein the surface of the developing sleeve used in Experiments 2 and 3 has been enlarged.
Figure 3B:
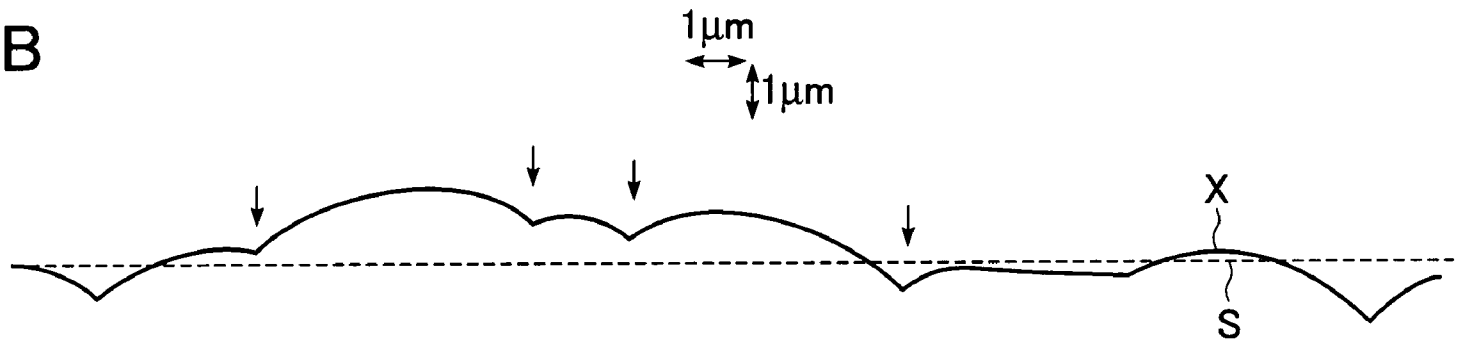

FIG. 3A illustrates the surface profile of the developing sleeve according to the second experiment example subjected to blasting using ARD #150, and FIG. 3B illustrates the surface profile of the first developing sleeve according to the third experiment example subjected to blasting using FGB #300.

As can be understood from FIGS. 3A and 3B, the profile obtained by the third experiment example has a curvature of the curve forming the peaks and troughs which is different from that of the sleeve according to the second experiments example, and is extremely smooth. Particularly, the developing sleeve according to the third experiment example has few minute recesses in the troughs, and detailed examination of the sleeve surface revealed that while the sleeve according to the second experiment example had approximately 30 recesses 1 μm in width and 0.5 μm in depth or more (portions indicted by the downward arrows in the drawings) over a length of 100 μm, the number was approximately 10 with the sleeve according to the third experiment example. This is thought to be due to reduction of small coarse formations on the surface of the sleeve owing to blasting with the determinate-form spherical particles, and this is assumed to be an improvement since fewer toner particles will become caught on the minute coarse formations.

Accordingly, from the perspective of sleeve staining, the Sm value of the first developing sleeve is preferably equal to or greater than the average granularity by weight of the carrier, and from the perspective of image quality, the Sm value of the second developing sleeve is preferably smaller than the average granularity by weight of the carrier.

Actual experimentation measuring the diameter of toner particles packed into the above-described recesses on the developing sleeve prior to fusing showed the toner particles to have extremely small grain diameters, around 2 to 3 μm. Three samples of developing agent were used to evaluate endurance, as shown in Table 2.

TABLE 2

| | Sample A | Sample B | Sample C |
|---|---|---|---|
| Average grain diameter by volume | 7.0 μm | 5.0 μm | 5.0 μm |
| Percentage by count of particles 4 μm or smaller | 17% | 40% | 30% |
| Percentage by count of particles 2 to 3 μm | 10% | 18% | 10% |

The results of studying these are shown in Table 3, which illustrates the staining level of the first and second developing sleeves after extensive use of 10,000 copies, i.e., the staining density (optical density difference (ΔD).

It can be understood from Table 3 that staining of the sleeve is greatly dependent on the percentage by count of the fine powder toner particles (particularly in the range of 2 to 3 μm) contained in the non-magnetic toner. That is to say, toner particles in the range of 2 to 3 μm for the grain diameter should be contained in the non-magnetic toner by no more than 18% by count, and even more preferably no more than 10% by count.

TABLE 3

| | Sample A | Sample B | Sample C |
|---|---|---|---|
| Second Experiment Example (First developing sleeve/Second developing sleeve) | 0.20/0.07 | 0.25/0.10 | 0.23/0.08 |
| Third Experiment Example (First developing sleeve/Second developing sleeve) | 0.05/0.05 | 0.15/0.10 | 0.10/0.07 |

With the twin-sleeve developing method of the developing device according to the present embodiment, the first developing sleeve 8 preferably has a great Sm value as to the Rz value in order to prevent sleeve staining which leads to deterioration in developability, as described above. That is to say, the sleeve surface is smooth in comparison with the size of the magnetic carrier, and the staining level of the sleeve can be reduced. Particularly, reducing the minute recesses by blasting with determinate-form spherical particles to yield a smooth surface is preferable.

On the other hand, the second developing sleeve 9 preferably has a small Sm value as to the Rz value in order to prevent uneven transportation of developing agent, which leads to image deterioration.

However, there was somewhat of a problem in the micro-level image quality such as dot reproducibility and the like in the above experiment. This is thought to be due to separation of functions between the first sleeve and the second sleeve in the above-described twin-sleeve developing method. In further detail, while developing efficiency is important with the first sleeve of the twin sleeves since the first sleeve functions to raise the toner layer potential by developing the toner, the image quality is primarily affected by the developing conditions of the second developing sleeve, since the second sleeve re-arrays the excessively-adhered toner so as to prevent white spots and determine the micro-level image quality. Accordingly, what is important is to increase the developing agent transporting capabilities of the second developing sleeve, and prevent deterioration of image quality due to substandard transportation of the developing agent, and particularly of the magnetic carrier. The ratio of the Rz value on the surface of the second developing sleeve 9 as to the Sm value is preferably made greater to this end. Accordingly, with the Fourth Experiment Example (Embodiment), the first developing sleeve was blasted with aluminum FGB #300, and the second developing sleeve was blasted with ARD #150, to yield the Rz and Sm values shown in Table 4. Table 4 illustrates the results of extensive use of 10,000 copies using the Sample C toner.

TABLE 4

| Fourth Experiment Example | First Developing Sleeve | Second Developing Sleeve |
|---|---|---|
| Developing sleeve material | Aluminum | Aluminum |
| Blasting for developing sleeve | FGB #300 | ARD #150 |
| Average inter-peak distance Sm | 40 μm | 40 μm |
| Ten-point average roughness Rz | 10 μm | 15 μm |
| Relative ratio of Rz/Sm | 0.25 | 0.375 |
| Staining density (ΔD) | 0.08 | 0.07 |

Now, increasing the ten-point average roughness Rz value allows the toner to catch more readily on the recesses of the surface, which is though to tend to worsen the staining level of the developing sleeve, but as described above, the staining of the second developing sleeve 9 is not as bad as that of the first developing sleeve 8 within the twin sleeve developing method as described above, so there is no problem as far as practical usage goes as long as the Sm is adjusted to a slightly higher level. Also, blasting with the non-determinate-form particles creates fine rough formations on the surface, which improves transporting capabilities of the developing agent, thereby preventing deterioration of image quality.

Now, studying in detail the relation between the Rz-Sm ratio (Rz1/Sm1, Rz2/Sm2), sleeve staining, and developing agent transporting capabilities, wherein Rz1 and Rz2 represent the ten-point average roughness Rz1 and Rz2 of the first and second developing sleeves 8 and 9, the Sm1 and Sm2 represent the average inter-peak distance of the first and second developing sleeves 8 and 9, showed that satisfactory results could be obtained in the event that the relation $$Rz1/Sm1 < Rz2/Sm2$$

holds (see Table 4).

However, making the average inter-peak distance Sm of the surface of the developing sleeve excessively great, or further making the ratio Rz/Sm of the ten-point average roughness Rz and average inter-peak distance Sm to be excessively small, makes the sleeve surface smooth, which could lower the developing agent transporting capabilities to where sufficient developing agent cannot be supplied to the electrostatic image formed on the image carrying member.

Now, with the Rz/Sm ratio for the first developing sleeve and the second developing sleeve being that described above, setting the average inter-peak distance Sm to ⅓ times to 3 times of the average granularity by weight D of the carrier in the two-component developing agent ($D/3 \leqq Sm \leqq 3 \times D$) improves the above problem. This is more preferably set to $D/2 \leqq Sm\ 2 \times D$.

Now, the method for measuring the average grain diameter of the carrier and toner will be described. With the present invention, the average granularity by weight of the carrier was measured according to the following procedures.

(1) Approximately 100 g of the sample ferrite carrier was measured to the order of 0.1 g.

(2) Standard sieves of 100 mesh to 400 mesh (hereafter referred to simply as "sieve") were used for the sieve, with the sieves being placed one on top another in the order of 100, 145, 200, 250, 350, and 400 mesh from the top, and with a dish placed at the bottom. The sample was placed on the topmost sieve and a lid was placed thereupon.

(3) This was placed in a vibrating device and sifted for 15 minutes being horizontally circled 285±6 times per minute and vibrated 150±10 times per minute.

(4) After sifting, the ferrite carrier in the sieves and in the dish were measured to the order of 0.1 g.

(5) The weight was measured to the second decimal by weight percent, and rounded off to the first decimal according to JIS-Z8401.

Note that at this time, the dimensions of the sieve are: inner diameter of 200 mm from above the sieve face; and depth of 4.5 mm from the upper faced to the sieve face. Also, the sum of the weight of ferrite carrier following sifting into each part may not be 99% or less than the initially-measured amount of the sample.

The average granularity by weight of the carrier is obtained by the following Expression, based on the measurement values of granularity distribution described above.

Average granularity by weight (μm)=1/100×{(amount remaining in 100 mesh sieve)×140+(amount remaining in 145 mesh sieve)×122+(amount remaining in 200 mesh sieve)×90+(amount remaining in 250 mesh sieve)×68+(amount remaining in 350 mesh sieve)×52+(amount remaining in 400 mesh sieve)×38+(amount passing through all sieves)×14}

With the present invention, the average granularity by volume of the toner were measured as follows. A Coulter Multisizer (manufactured by Beckman Coulter, Inc.) was used for the measurement instrument, to which an interface for outputting average distribution by count and volume average distribution (manufactured by Nikkaki) and a CX-i personal computer (Manufactured by Canon Kabushiki Kaisha) were connected, and for the electrolytic fluid, a 1% NaCl solution was prepared using primary sodium chloride. For measurement, 0.1 to 5 ml of a surfactant (preferably alkylbenzene sulfonate) is added into 100 to 150 ml of the electrolytic fluid as a dispersant, and further, 0.5 to 50 mg of the sample to be measured was added thereto. The electrolytic fluid with the sample in suspension therein was subjected to dispersion for 1 to 3 minutes using an ultrasound dispersing device, followed which the Coulter Multisizer was used to measure the granularity distribution of particles 2 to 40 μm with a 100 μm aperture, thereby obtaining average grain diameter and the percentage by count of the sample.

Second Embodiment

Figure 4:
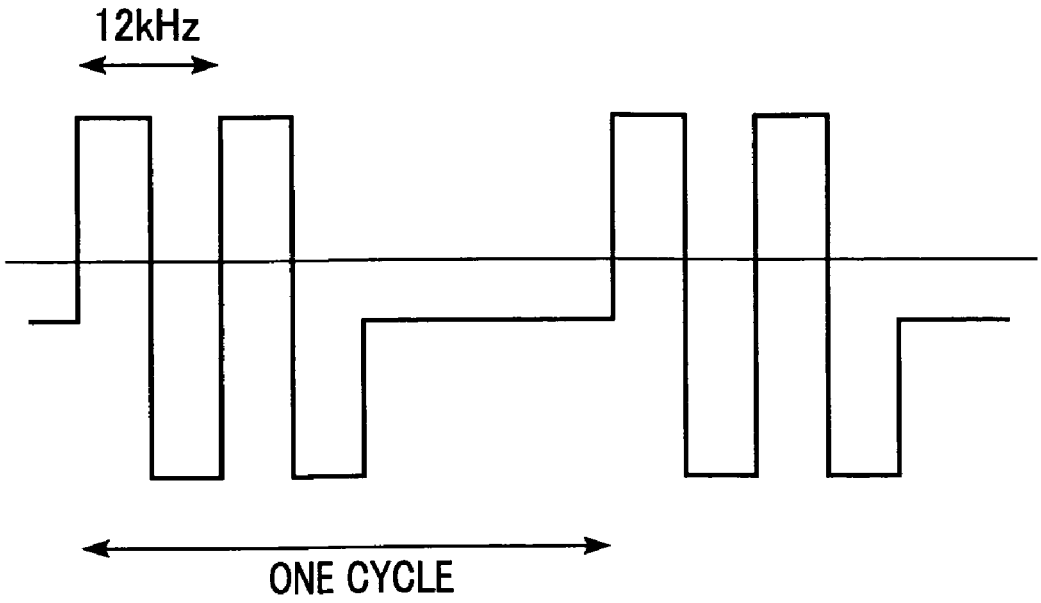
FIG. 4 is a diagram describing the blank pulse developing bias used with the present invention.

With this embodiment, a blank bias pulse such as shown in FIG. 4 was used as the developing bias superimposed on the developing sleeve of the developing device according to the first embodiment. This bias is characterized by having no developing selectivity as compared to DC bias and rectangular bias, and extremely high highlight reproduction, and accordingly is capable of high image quality, but sampling the granularity distribution on the sleeve and the granularity distribution developed on the photosensitive drum showed as certain level of coarse grain developing. As a result, fine powder is accumulated within the developing device following extensive use.

Actual endurance testing with the Sample A showed that the toner particles having grain diameter of 4 μm or smaller increased from an initial 10% to 18% at the end of the test.

However, there was no sleeve staining with the above-described developing sleeve surface shape.

Third Embodiment

This embodiment involves forming the surface of the developing sleeves by performing roughening processing on the surfaces of the developing sleeves 8 and 9 in the same way as with the second embodiment, following which Ni—P electroplating, Ni—B electroplating, or Cr electroplating is coated thereupon.

Electroplating the surface of the first and second developing sleeves 8 and 9 with Ni—P, Ni—B, or Cr improves the friction resistance of the developing sleeves 8 and 9, in addition to facilitating control of the surface roughness. Also, the fine burring generated at the time of cutting the developing sleeve can also be smoothed, as described in the first embodiment.

In the event that aluminum is used as the material for the developing sleeves 8 and 9, the cost can be reduced as compared to stainless steel, but the hardness of the surface of the developing sleeves 8 and 9 is low, so in the event of using a two-component developing agent including a carrier, the friction resistance deteriorates, resulting in shorter lifespans of the developing sleeves 8 and 9.

However, the surface hardness of aluminum developing sleeves 8 and 9 increases over that of untreated aluminum by coating Ni—P, Ni—B, or Cr electroplating, thereby extending the life of the developing sleeves.

As described above, performing Ni—P electroplating, Ni—B electroplating, or Cr electroplating on the surface of the developing sleeves subjected to roughening processing enables the surface of the developing sleeves to be easily adjusted to a suitably rough state whereby the advantages of the first embodiment can be obtained, and further, the friction resistance of the surface of the developing agent carrying member can be improved.

Fourth Embodiment

With the present embodiment, the desired surface state is obtained by coating the surface of the developing sleeves following coarsening, as with the third embodiment, but the present embodiment differs from the third embodiment in that a resin layer including crystalline graphite and electroconductive carbon is coated. The resin layer coating is capable of achieving increased ease of forming a desired surface shape, and hardening and developing sleeves, as with the Ni—O, Ni—B, or Cr coating in the third embodiment.

As described above, coating a resin layer including crystalline graphite and electroconductive carbon on the surface of the developing sleeves subjected to roughening processing enables the surface of the developing sleeves to be easily adjusted to a suitably rough state whereby the advantages of the first embodiment can be obtained, and further, the friction resistance of the surface of the developing sleeves can be improved.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device for developing an electrostatic image formed on an image carrying member, said developing device comprising:

a developing container for containing a developer including toner and carrier;

a first developer carrying member for carrying the developer within said developing container and supplying the developer to the electrostatic image formed on said image carrying member;

a restricting member for restricting a thickness of the developer carried on said first developer carrying member; and a second developer carrying member for carrying the developer received from said first developer carrying member and supplying the developer to the electrostatic image formed on said image carrying member, wherein an average inter-peak distance on a surface of said first developer carrying member is greater than an average inter-peak distance on a surface of said second developer carrying member.

2. A developing device according to claim 1, wherein the expression $$Sm2 < D \leqq Sm1 \text{ is satisfied,}$$

where Sm1 represents the average inter-peak distance on the surface of said first developer carrying member, Sm2 represents the average inter-peak distance on the surface of said second developer carrying member, and D represents an average grain diameter by weight of the carrier.

3. A developing device according to claim 1, wherein the expression $$(Rz1/Sm1) < (Rz2/Sm2) \text{ is satisfied,}$$

where Sm1 represents the average inter-peak distance on the surface of said first developer carrying member, Sm2 represents the average inter-peak distance on the surface of said second developer carrying member, Rz1 represents a ten-point average roughness of said first developer carrying member, and Rz2 represents a ten-point average roughness of said second developer carrying member.

4. A developing device according to claim 3, wherein the expression $$(D/3) \leqq Sm1 \leqq 3 \times D$$

and $$(D/3) \leqq Sm2 \leqq 3 \times D \text{ are satisfied,}$$

where D represents an average grain diameter by weight of the carrier.

5. A developing device according to claim 4, wherein the expression $$(D/2) \leqq Sm1 \leqq 2 \times D$$

and $$(D/2) \leqq Sm2 \leqq 2 \times D \text{ are satisfied.}$$

6. A developing device according to claim 1, wherein the surface of said first developer carrying member is subjected to roughening processing using essentially-spherical polishing particles, and the surface of said second developer carrying member is subjected to roughening processing using non-spherical polishing particles.

7. A developing device according to claim 1, wherein a direction of rotation of said first developer carrying member and said second developer carrying member is the same.

8. A developing device according to claim 1, further comprising first magnetic field generating means fixed within said first developer carrying member, for magnetically transporting developer, and second magnetic field generating means fixed within said second developer carrying member, for magnetically transporting developer, wherein said first magnetic field generating means and said second magnetic field generating means have magnetic poles of the same magnetic polarity at a position where said first magnetic field generating means and said second magnetic field generating means face one another.

9. A developing device for developing an electrostatic image formed on an image carrying member, said developing device comprising:

a developing container for containing a developer including toner and carrier;

a first developer carrying member for carrying the developer within said developing container and supplying the developer to the electrostatic image formed on said image carrying member;

a restricting member for restricting a thickness of the developer carried on said first developer carrying member; and a second developer carrying member for carrying developer received from said first developer carrying member and supplying the developer to the electrostatic image formed on said image carrying member, wherein the expression $$(Rz1/Sm1)<(Rz2/Sm2) \text{ is satisfied,}$$

where Sm1 represents an average inter-peak distance on a surface of said first developer carrying member, Sm2 represents an average inter-peak distance on a surface of said second developer carrying member, Rz1 represents a ten-point average roughness of said first developer carrying member, and Rz2 represents a ten-point average roughness of said second developer carrying member.

10. A developing device according to claim 9, wherein the expression $$(D/3)\leqq Sm1\leqq 3\times D$$

and $$(D/3)\leqq Sm2\leqq 3\times D \text{ are satisfied,}$$

where D represents an average grain diameter by weight of the carrier.

11. A developing device according to claim 10, wherein the expression:

$$(D/2)\leqq Sm1\leqq 2\times D$$

and $$(D/2)\leqq Sm2\leqq 2\times D \text{ are satisfied.}$$

12. A developing device according to claim 9, wherein a direction of rotation of said first developer carrying member and said second developer carrying member is the same.

13. A developing device according to claim 9, further comprising first magnetic field generating means fixed within said first developer carrying member, for magnetically transporting developer, and second magnetic field generating means fixed within said second developer carrying member, for magnetically transporting developer, wherein said first magnetic field generating means and said second magnetic field generating means have magnetic poles of the same magnetic polarity at a position where said first magnetic field generating means and said second magnetic field generating means face one another.

* * * * *

UNITED STATES PATENT AND TRADEMARK OFFICE

CERTIFICATE OF CORRECTION

PATENT NO. : 7,054,583 B2
APPLICATION NO. : 10/675988
DATED : May 30, 2006
INVENTOR(S) : Fumitake Hirobe It is certified that error appears in the above-identified patent and that said Letters Patent is hereby corrected as shown below:

ON THE TITLE PAGE

At Item (57), Abstract, line 10, “course” should read --coarse--.

COLUMN 1

Line 51, “rotation” should read --rotations--; and
Line 65, “handled” should read --handed--.

COLUMN 2

Line 36, “sleeve.” should read --sleeves.--; and
Line 56, “carriers,” should read --carrier,--.

COLUMN 3

Line 7, “carryout” should read --carry out--.

COLUMN 4

Line 42, “Rz1” should read --Rz2--.

COLUMN 7

Line 56, “handling” should read --handing--; and
Line 65, “burst” should read --brush--.

COLUMN 9

Line 11, “then” should be deleted.

COLUMN 10

Line 9, “particularly” should read --preferably--.

COLUMN 11

Line 27, “experiments” should read --experiment--;
Line 35, “indicted” should read --indicated--; and
Line 50, “above-describe” should read --above-described--.

COLUMN 12

Line 19, “(ΔD).” should read --(ΔD)).--.

COLUMN 13

Line 24, “though” should read --thought--; and
Line 61, “(D/2≦Sm 2xD)” should read --(D/2≦Sm≦2xD)--.

UNITED STATES PATENT AND TRADEMARK OFFICE

CERTIFICATE OF CORRECTION

PATENT NO. : 7,054,583 B2
APPLICATION NO. : 10/675988
DATED : May 30, 2006
INVENTOR(S) : Fumitake Hirobe It is certified that error appears in the above-identified patent and that said Letters Patent is hereby corrected as shown below:

COLUMN 14

Line 3, “top” should read --top of--;
Line 18, “4.5mm” should read --45 mm-- and “faced” should read --face--;
Line 31, “sieves)x14}” should read --sieves)x14}.--; and
Line 47, “followed” should read --following--.

COLUMN 16

Line 42, “expression” should read --expressions--; and
Line 51, “expression” should read --expressions--.

COLUMN 18

Line 4, “expression” should read --expressions--; and
Line 12, “expression” should read --expressions--

Signed and Sealed this

Twelfth Day of December, 2006

JON W. DUDAS
*Director of the United States Patent and Trademark Office*